US010923847B2

(12) United States Patent
Demaratos et al.

(10) Patent No.: US 10,923,847 B2
(45) Date of Patent: Feb. 16, 2021

(54) MALE TERMINAL POSITION ASSURANCE (TPA) DEVICE FOR A CONNECTOR AND METHOD FOR ASSEMBLING THEREOF

(71) Applicant: J.S.T. CORPORATION, Farmington Hills, MI (US)

(72) Inventors: David Demaratos, Wixom, MI (US); Frank Holub, West Bloomfield, MI (US)

(73) Assignee: J.S.T. CORPORATION, Farmington Hills, MI (US)

( * ) Notice: Subject to any disclaimer, the term of this patent is extended or adjusted under 35 U.S.C. 154(b) by 0 days.

(21) Appl. No.: 16/389,928

(22) Filed: Apr. 20, 2019

(65) Prior Publication Data

US 2020/0274282 A1 Aug. 27, 2020

Related U.S. Application Data

(60) Provisional application No. 62/810,179, filed on Feb. 25, 2019.

(51) Int. Cl.
*H01R 13/436* (2006.01)
*H01R 43/20* (2006.01)
(Continued)

(52) U.S. Cl.
CPC ..... *H01R 13/436* (2013.01); *H01R 13/424* (2013.01); *H01R 13/4362* (2013.01);
(Continued)

(58) Field of Classification Search
CPC ..... H01R 13/4223; H01R 13/4362; H01R 13/502; H01R 13/629; H01R 13/639; H01R 43/20
(Continued)

(56) References Cited

U.S. PATENT DOCUMENTS 4,946,399 A * 8/1990 Kawashima ..... H01R 13/436 439/752
5,281,168 A * 1/1994 Krehbiel ..... H01R 13/4362 439/595
(Continued)

FOREIGN PATENT DOCUMENTS

DE 102014108283 A1 12/2015
WO 2018/215026 A1 11/2018

OTHER PUBLICATIONS

International Search Report of the International Searching Authority for International Application No. PCT/US2019/029536 dated Jul. 10, 2019 (2 sheets).
(Continued)

*Primary Examiner* — Oscar C Jimenez
(74) *Attorney, Agent, or Firm* — Kratz, Quintos & Hanson, LLP

(57) ABSTRACT

A male terminal position assurance (TPA) device for a male connector assembly, preferably for a high voltage connector assembly. The male TPA has a substantially wing-like shaped upper member that respectively locks terminals inside a male inner housing, and further has a flexible arm member, in a lower member thereof, that locks the male TPA device in the male inner housing. The male TPA device does not lock inside the male inner housing if it detects that the corresponding terminal has not been fully inserted or installed into the male inner housing. The male inner housing includes a primarily lock for locking the terminal, while the male TPA device, when in full-lock position, provides for a secondary lock for locking the terminal inside the inner housing. When in the full-lock position inside the male inner housing, the male TPA device assures that the necessary retention forces are provided to ensure that the terminal remains fully locked within the male connector assembly.

19 Claims, 13 Drawing Sheets

(51) Int. Cl.
*H01R 13/424* (2006.01)
*H01R 13/502* (2006.01)
*H01R 13/629* (2006.01)
*H01R 13/639* (2006.01)

(52) U.S. Cl.
CPC ..... *H01R 13/502* (2013.01); *H01R 13/629* (2013.01); *H01R 13/639* (2013.01); *H01R 43/20* (2013.01)

(58) Field of Classification Search
USPC ..... 439/752
See application file for complete search history.

(56) References Cited

U.S. PATENT DOCUMENTS 5,516,308 A * 5/1996 Yamanashi ..... H01R 13/4362 439/752
5,518,334 A * 5/1996 Yagi ..... H01R 13/4223 220/839
5,595,509 A * 1/1997 Fry ..... H01R 13/4362 439/595
5,967,842 A * 10/1999 Okabe ..... H01R 13/4362 439/596
6,155,888 A * 12/2000 Kurimoto ..... H01R 13/4362 439/595
6,183,314 B1 * 2/2001 Wada ..... B29C 45/006 439/752
6,358,102 B1 * 3/2002 Fukamachi ..... H01R 13/4362 439/752
6,655,998 B1 * 12/2003 Kurimoto ..... H01R 13/4362 439/595
2003/0096539 A1 * 5/2003 Ichio ..... H01R 13/4362 439/752
2007/0093131 A1 * 4/2007 Takahashi ..... H01R 13/4361 439/595
2009/0130902 A1 * 5/2009 Hall ..... H01R 13/4361 439/595
2012/0214358 A1 * 8/2012 Takahashi ..... H01R 13/4361 439/865
2013/0023137 A1 * 1/2013 Glick ..... H01R 13/426 439/246
2017/0207577 A1 7/2017 Holub
2018/0261946 A1 * 9/2018 Hori ..... H01R 13/424
2018/0316132 A1 11/2018 Holub

OTHER PUBLICATIONS

Written Opinion of the International Searching Authority for International Application No. PCT/US2019/029536 dated Jul. 10, 2019 (4 sheets).

* cited by examiner

MALE TERMINAL POSITION ASSURANCE (TPA) DEVICE FOR A CONNECTOR AND METHOD FOR ASSEMBLING THEREOF

CROSS-REFERENCE TO RELATED APPLICATION

This patent application claims priority to U.S. Provisional Patent Application No. 62/810,179 filed Feb. 25, 2019, which is hereby incorporated herein by reference in its entirety.

BACKGROUND OF THE INVENTION

In a male connector assembly, it is desired that the terminals be further provided with secondary locks, in addition to providing primary locks for terminals inside a male inner housing. The secondary locks for the terminals provide for much higher retention forces (in comparison with only the primary locks), and provide a higher assurance that the terminals remain locked inside the male inner housing. It is further desired that a detection be made if the terminals are not fully inserted or installed inside the male inner housing so that if such a detection is made, the secondary locks of the terminals do not function.

The male terminal position assurance (TPA) device of this invention provides the essential secondary locks for providing the much higher retention forces and the higher assurance that the terminals remain locked inside the male inner housing. The male TPA device of this invention also provides the needed detection if the terminals are not fully inserted or installed inside the male inner housing so that if such a detection is made, the secondary locks provided by the male TPA device do not occur. That is, once it is detected that the terminals have been fully inserted into the male inner housing and that the primary locks for the terminals inside the inner housing has occurred, the male TPA device of this invention is able to be inserted into the male inner housing and thereby provide the secondary locks for the terminals for a much higher assurance that the terminals remain locked inside the inner housing.

SUMMARY OF THE INVENTION

This invention is directed to a male TPA device for a male connector assembly, preferably for a high voltage male connector assembly. The male TPA device of this invention does not lock inside the male connector assembly if it detects that the corresponding terminal has not been fully inserted or installed into the male connector assembly; and simultaneously, if the corresponding terminal is not in the fully locked position within the male connector assembly, the terminal blocks or prevents the male TPA device from being locked in the male connector assembly.

Moreover, if the male TPA is not in the full-lock position in the male connector assembly, the male connector assembly is, in turn, unable to mate with a female connector assembly. When in the full-lock position, the male TPA device provides the high assurance for the retention forces necessary to lock and retain the terminal within the male connector assembly.

DETAILED DESCRIPTION OF THE PREFERRED EMBODIMENTS

Figure 1:
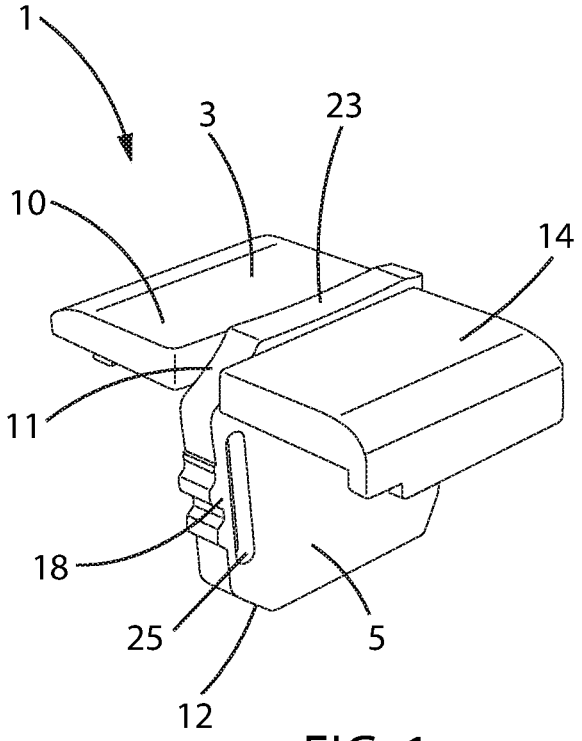
FIG. 1 is a front perspective view of a male terminal position assurance (TPA) device of this invention for use in a connector assembly.

FIG. 1 illustrates a front perspective view of the male terminal position (TPA) device, generally referred to as reference numeral 1. The male TPA device 1 includes an upper member 3 and a lower member 5. The upper member 3 has a substantially wing-like shape having sides 10, 14. The lower member 5 includes a flexible arm member 18 in a front portion thereof.

Figure 2:
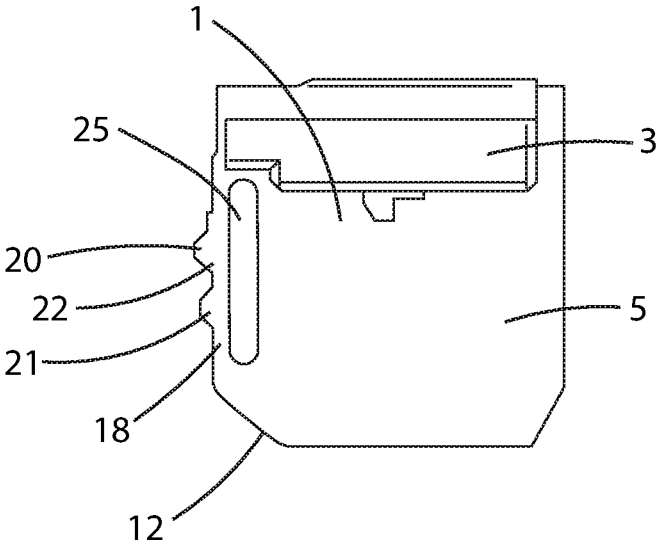
FIG. 2 is a side elevational view of the male TPA device of this invention.

As shown in FIG. 2, the flexible arm member 18 includes at least a protruding member or nub member 20. Although the number of protruding members or nub members 20 shown in FIG. 2 is two, it is not limited thereto. The two protruding members or nub members 20 are a lower protruding member or lower nub member 21 and an upper protruding member or an upper nub member 22. A substantially elongated slot 25 passing through the lower member 5 is located adjacent the flexible arm member 18. The substantially elongated slot 25 being adjacent to the flexible arm member 18 provides the necessary flexibility for the flexible arm member 18. An upper front portion 11 of the flexible arm member 18 is, as shown in FIG. 1, at an incline. Also, a lower front portion 12 of the flexible arm member 18 is, as shown in FIG. 1, at an incline. The functions or significance of the upper inclined front portion 11 and the lower inclined front portion 12 of the flexible arm member 18 are explained further below.

Figure 3:
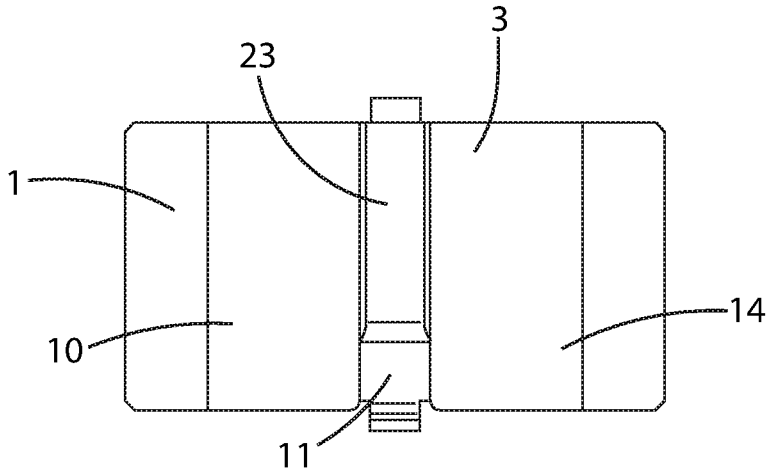
FIG. 3 is a top elevational view of the male TPA device of this invention.

Shown in FIG. 3 is a top elevational view of the male TPA device 1 of this invention, which shows the sides 10, 14 of the upper member 3 as being substantially symmetrical. Also illustrated in FIG. 3 is a central member 23 that traverses, from front to back, along the upper member 3 respectively joining on both sides thereof the sides 10, 14 of the upper member 3.

Figure 4:
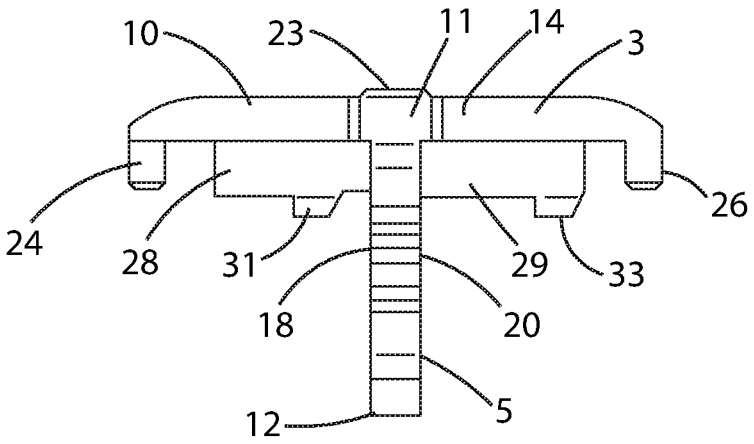
FIG. 4 is a front elevational view of the male TPA device of this invention.

The wing-like shape of the upper member 3 is best seen in the front elevational view in FIG. 4 of the male TPA device 1 of this invention. Further illustrated in FIG. 4 are end members 24, 26 extending substantially downward from the sides 10, 14, respectively. Also extending substantially downward from the sides 10, 14 are intermediate members 28, 29, respectively. Each intermediate member 28, 29 has a corresponding nub 31, 33, respectively, extending downward therefrom. As will later be explained, the end members 24, 26 are accommodated within elongated grooves 70, 72, respectively, located along upper sides 74 of the male inner housing 30 (see FIG. 12). As will later also be explained, the intermediate members 28, 29 of the male TPA device 1 are inserted or accommodated within corresponding slots 68 of the corresponding terminals 65 (see, e.g., FIGS. 9 and 10). FIG. 4 also shows the inclined upper front portion 11 of the flexible arm member 18 and the inclined lower front portion 12 of the flexible arm member 18.

Figure 5A:
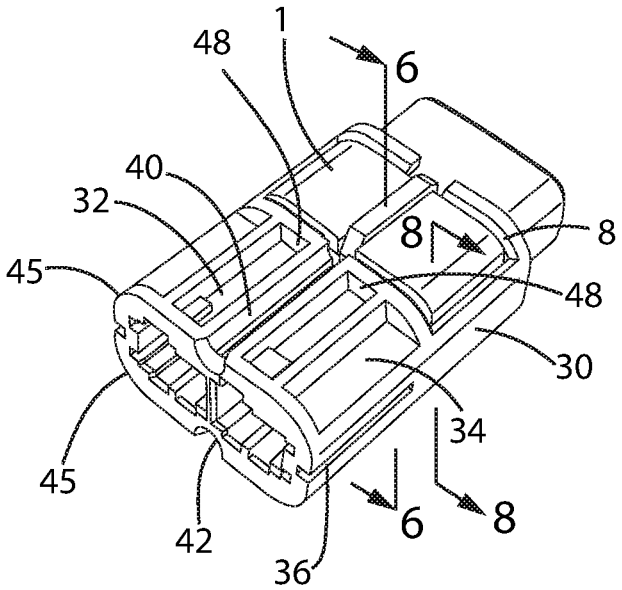
FIG. 5A is a perspective view of the male TPA device of this invention fitted or installed, in a male inner housing, at a pre-lock position.
Figure 5B:
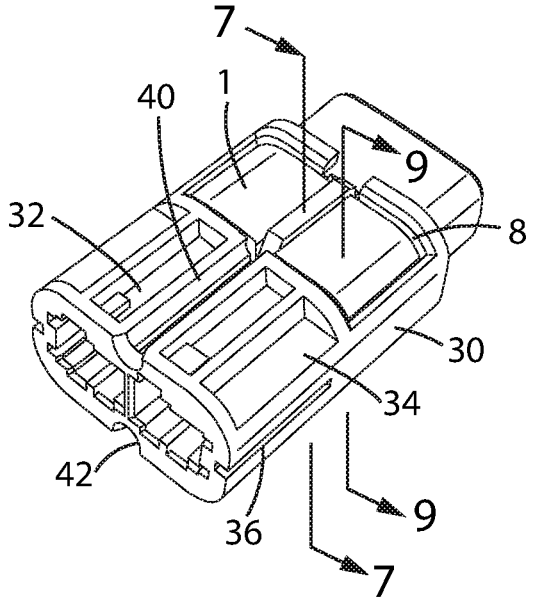
FIG. 5B is a perspective view of the male TPA device of this invention fitted or installed, in a male inner housing, at a full-lock position.

The male TPA device 1 is shown in FIG. 5A as being inserted through an opening 8 passing through an upper portion of the male inner housing 30, and fitted or installed, in the male inner housing 30, at a pre-lock position, while FIG. 5B shows the male TPA device 1 being inserted through the opening 8 passing through the upper portion of the male inner housing 30, and fitted or installed in the male inner housing 30, at a full-lock position. Each of FIGS. 5A and 5B shows fitting grooves 32, 34, 36 on the external surfaces of the inner male housing 30 for allowing the male TPA device 1 to be installed or inserted into a male outer housing 60 (see, FIG. 6).

Also illustrated in each of FIGS. 5A and 5B are upper elongated groove 40 and lower elongated groove 42. The upper elongated groove 40 is a substantially half-circle groove and extends from a front portion 45 of the male inner housing 30 to a middle portion 48 thereof abutting the male TPA device 1. Similarly, the lower elongated groove 42 is a substantially half-circle groove and extends from a front portion 45 of the male inner housing 30 to a middle portion 48 thereof abutting the male TPA device 1. The functions or significance of the upper elongated groove 40 and the lower elongated groove 42 will later be explained.

Figure 6:
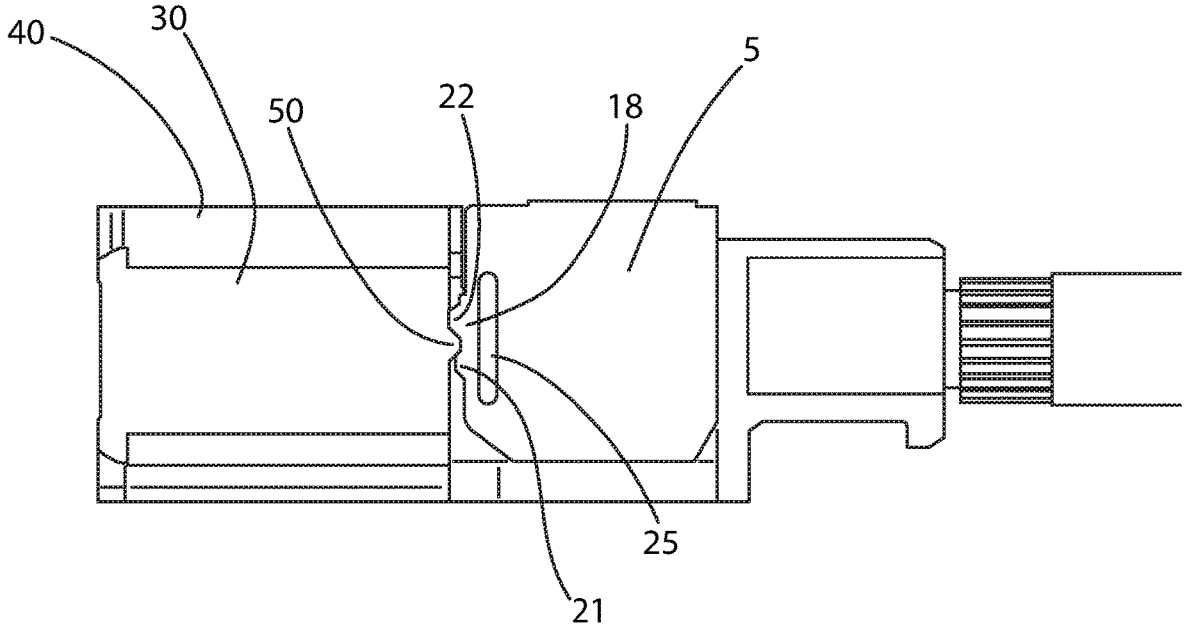
FIG. 6 is a cross-sectional view taken along cross-sectional line 6-6 in FIG. 5A showing a lower member of the male TPA device in a pre-lock position inside the male inner housing.

FIG. 6 is a cross-sectional view, taken along line 6-6 in FIG. 5A, showing the protruding members or nub members 20 of the flexible arm member 18 in engagement with a protruding member or nub member 50 inside the male inner housing 3. As shown in FIG. 6, a lower protruding member or nub member 21 of the flexible arm member 18, upon the lower member 5 of the male TPA device 1 being pushed in the downward direction, bypasses and travels towards beneath the protruding member or nub member 50 of the male inner housing 30. At this time, the lower member 5 or the male TPA device 1 is at a pre-lock position inside the male inner housing 30.

Further illustrated in FIG. 6 is an arrow passing along the upper groove 40 through which a working device (not shown) is inserted and pushed towards the inclined upper front portion 11 of the flexible arm member 18 upon which the central member 23 is pushed downward, and in turn, the male TPA device 1 is pushed downward, until, as described earlier, the lower protruding member or lower nub member 21 of the flexible member 18 passes and travels towards beneath the protruding member or nub member 50 of the male inner housing 30 so that the lower member 5 or the male TPA device 1 is at a pre-lock position inside the male inner housing 30.

Figure 7:
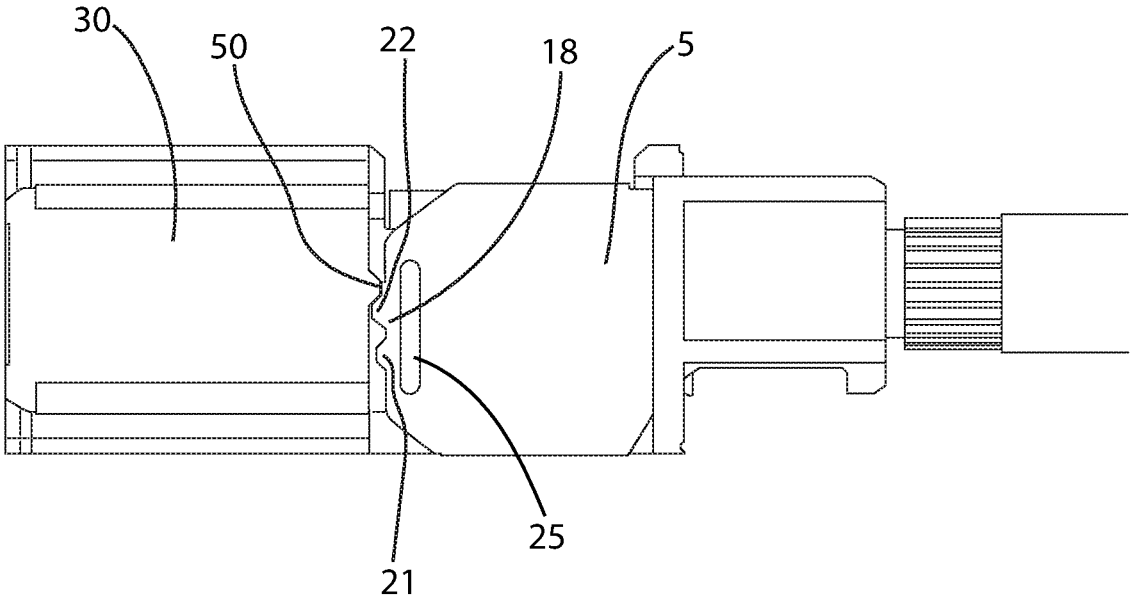
FIG. 7 is a cross-sectional view taken along cross-sectional line 7-7 in FIG. 5B showing the lower member of the male TPA device in a full-lock position inside the male inner housing.

When the working device (not shown) is further inserted and pushed towards the inclined upper portion 11 of the flexible arm member 18, along the upper elongated groove 40 of the male inner housing 30 (see arrow in FIG. 6), the central member 23 of the male TPA device 1 is further pushed downward so that the upper protruding member or upper nub member 22 of the flexible arm 18 travels towards beneath the protruding member or nub member 50 of the inner housing 30 so that the lower member 5 or the male TPA device 1 is at a full-lock position inside the male inner housing 30. The lower member 5 or the male TPA device 1 being in a full-lock position, within the male inner housing 30, is shown in FIG. 7.

Figure 8:
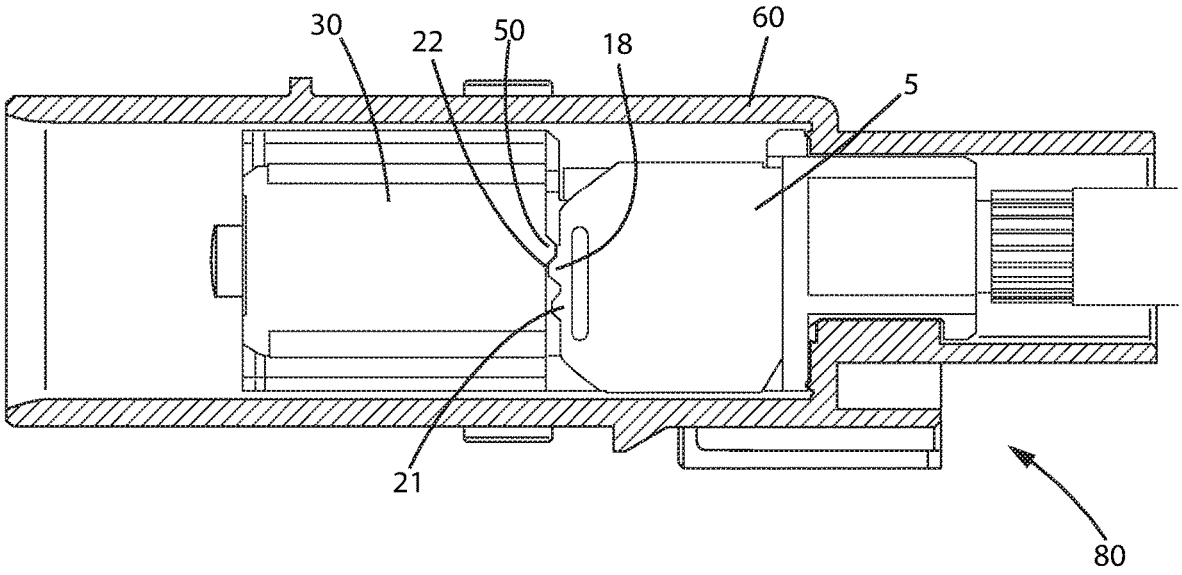
FIG. 8 is a cross-sectional view, similar to that shown in FIG. 7 with the lower member of the male TPA device in full-lock position inside the male inner housing, the male inner housing with the male TPA device being placed inside a male outer housing that forms a male connector assembly.

Shown in FIG. 8 is a male connector assembly, generally referred to as reference number 80, in which the male TPA device 1 is in full-lock position inside the male inner housing 30, the male inner housing 30 being inside a male outer housing 60.

As discussed earlier with respect to, for example, FIG. 4, the male TPA device 1 has a substantially wing-like shape with the sides 10, 14 with the end members 24, 26 extending substantially downward from the sides 10, 14, respectively. Also extending substantially downward from the sides 10, 14 are intermediate members 28, 29, respectively. Each intermediate member 28, 29 has a corresponding nub 31, 33, respectively, extending downward therefrom.

Figure 9:
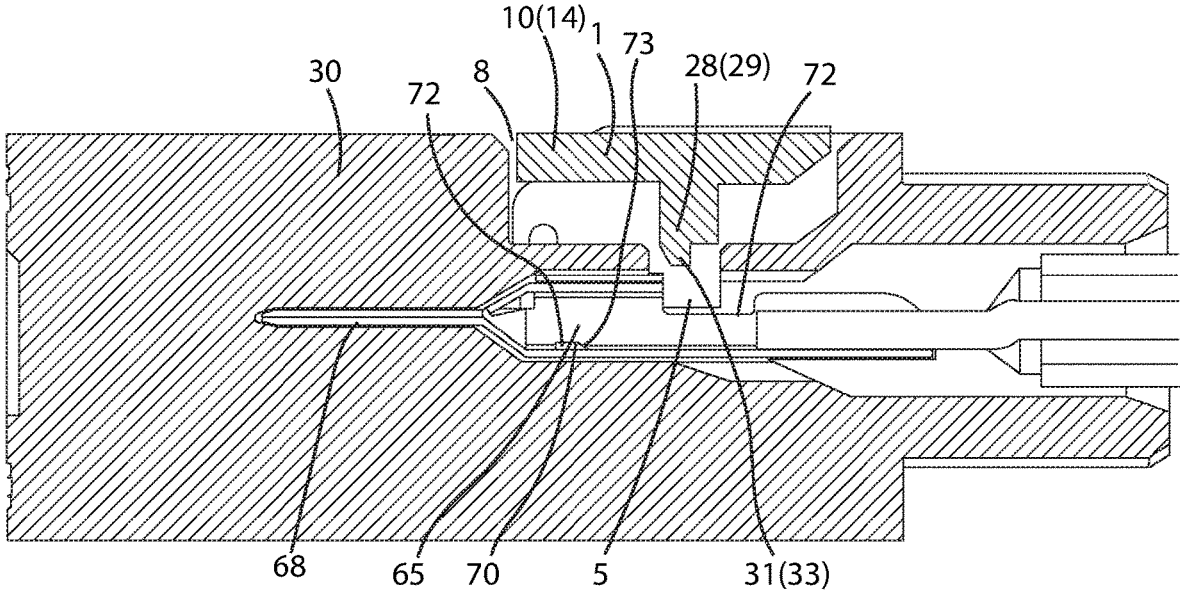
FIG. 9 is a cross-sectional view taken along cross-sectional line 9-9 in FIG. 5A showing intermediate members of the male TPA device, in the pre-lock position, inside the male inner housing.

As illustrated in FIG. 9, a terminal 65 having a leading end 68 is fully inserted or installed inside the male inner housing 30 for allowing the corresponding intermediate member 28, 29, and the corresponding nub 31, 33 of the male TPA device 1 to be fitted or accommodated within a corresponding slot 72 of the corresponding terminal 65. As shown in FIG. 9, an upward extending nub 70 at a lower portion inside the male inner housing 30 with a ramp-like rear edge 73 is snapped towards the inside of a notch 72 at a lower portion of the terminal 65 when the terminal 65 is inserted into the male inner housing 30. The ramp-like rear edge 73 of the upward extending nub 70 allows for easy insertion of the terminal 65 into the male inner housing 30, until such time as the upward extending nub 70 at the lower portion inside the male inner housing 30 snaps inside the notch 72 at the lower portion of the terminal 65, which locks (i.e., the primary locks for the terminals 65 inside the male inner housing 30) the terminal 65 and prevents the terminal 65 from being pulled out from the male inner housing 30.

FIG. 9 clearly shows the terminal 65 fully inserted inside the male inner housing 30, which consequently aligns the corresponding slot 72 of the corresponding terminal 65 beneath a corresponding one of the intermediate members 28, 29 (with a corresponding one of the nubs 31, 33) of the male TPA device 1, thereby allowing the corresponding one of the intermediate members 28, 29 (with a corresponding one of the nubs 31, 33) to be accommodated or inserted within the corresponding slot 72 of the corresponding terminal 65 when the male TPA device 1 is pushed downward, as discussed earlier with respect to, for example, FIGS. 6 and 7. Shown in FIG. 9 is the male TPA device 1 in a pre-lock position with the corresponding one of the intermediate members 28, 29 ready to be inserted or accommodated inside the corresponding slot 72 of the corresponding terminal 65 in the event that the male TPA device 1 is pushed further downward at full-lock position.

Figure 10:
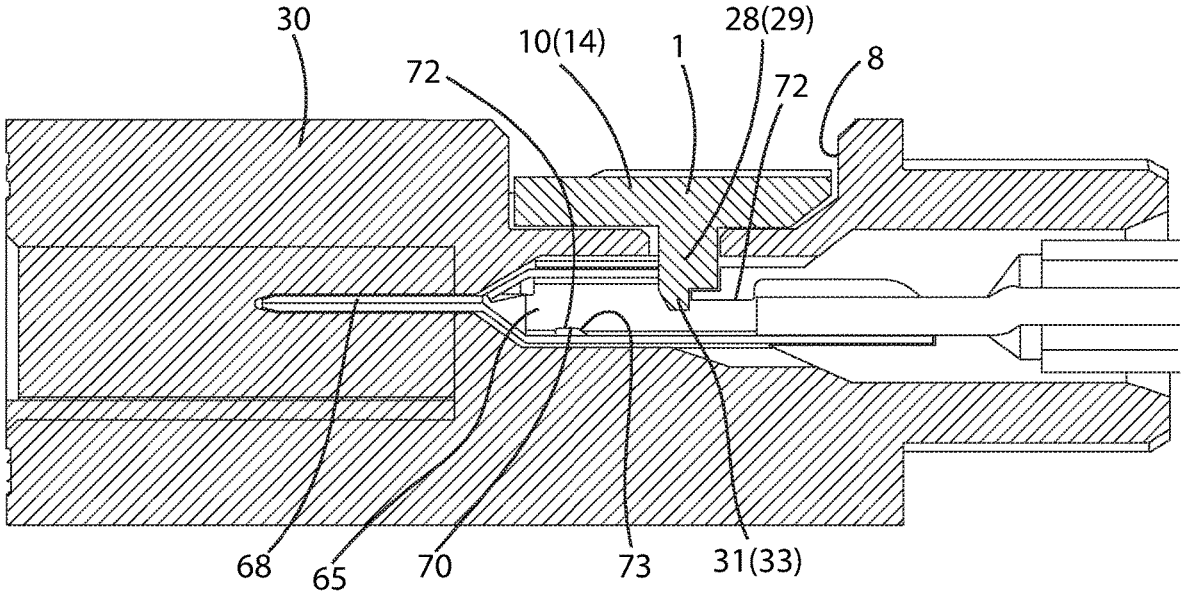
FIG. 10 is a cross-sectional view taken along cross-sectional line 10-10 in FIG. 5B showing the intermediate members of the male TPA device, in the full-lock position, inside the male inner housing.

Illustrated in FIG. 10 is the male TPA device 1 at full-lock position. As shown, the male TPA device 1 has further been pushed downward from pre-lock position (see FIG. 9) to full-lock position (see FIG. 10) with the corresponding one of the intermediate members 28, 29 of the male TPA device 1 having been fully inserted or accommodated within the corresponding slot 72 of the corresponding terminal 65. Consequently, with the male TPA device 1 in full-lock position inside the male inner housing 30, the terminal 65 cannot be pulled away from the male inner housing 30 (i.e., the secondary locks for the terminals 65 inside the male inner housing 30).

Figure 11:
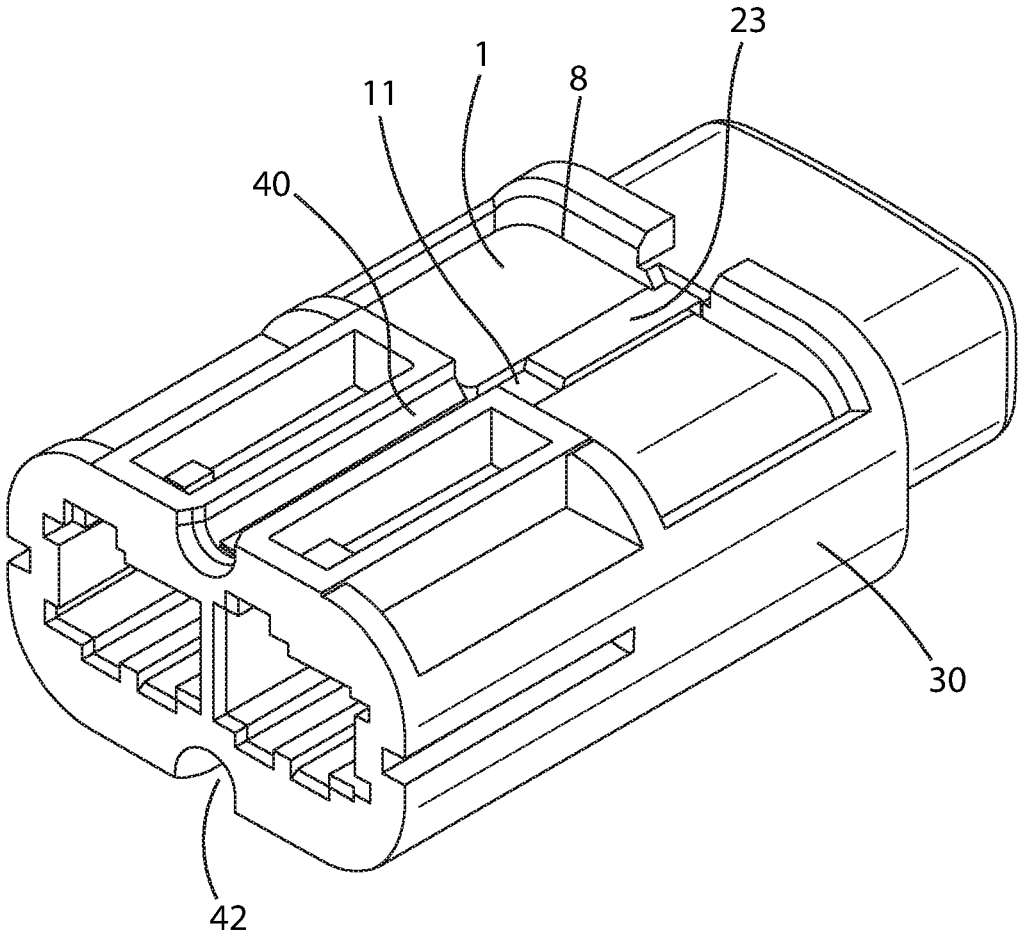
FIG. 11 is a top perspective view of the male inner housing assembly with the male TPA device inserted or accommodated therein in full-lock position showing the path of a working device for lowering the male TPA device inside the male inner housing.

FIG. 11 shows the arrow (similarly shown in FIG. 6) passing along the upper groove 40 through which the working device (not shown) is inserted and pushed towards the inclined upper front portion 11 of the flexible arm member 18 upon which the central member 23 of the male TPA device 1 is pushed downward, and in turn, the TPA device 1 is pushed downward towards the pre-lock position and, subsequently, towards the full-lock position, as discussed earlier. In other words, FIG. 11 shows, in a top perspective view, the male TPA device 1 in the full-lock position, inside the inner housing 30. Further shown in FIG. 11 is the arrow that illustrates the path through which the working device (not shown) passes along the upper groove 40 of the inner housing 30 towards the inclined upper front portion 11 of the flexible arm member 18 upon which the central member 23 of the male TPA device 1 and, in turn, the male TPA device 1 is pushed downwards towards the pre-lock position and ultimately, towards the full-lock position.

Figure 12:
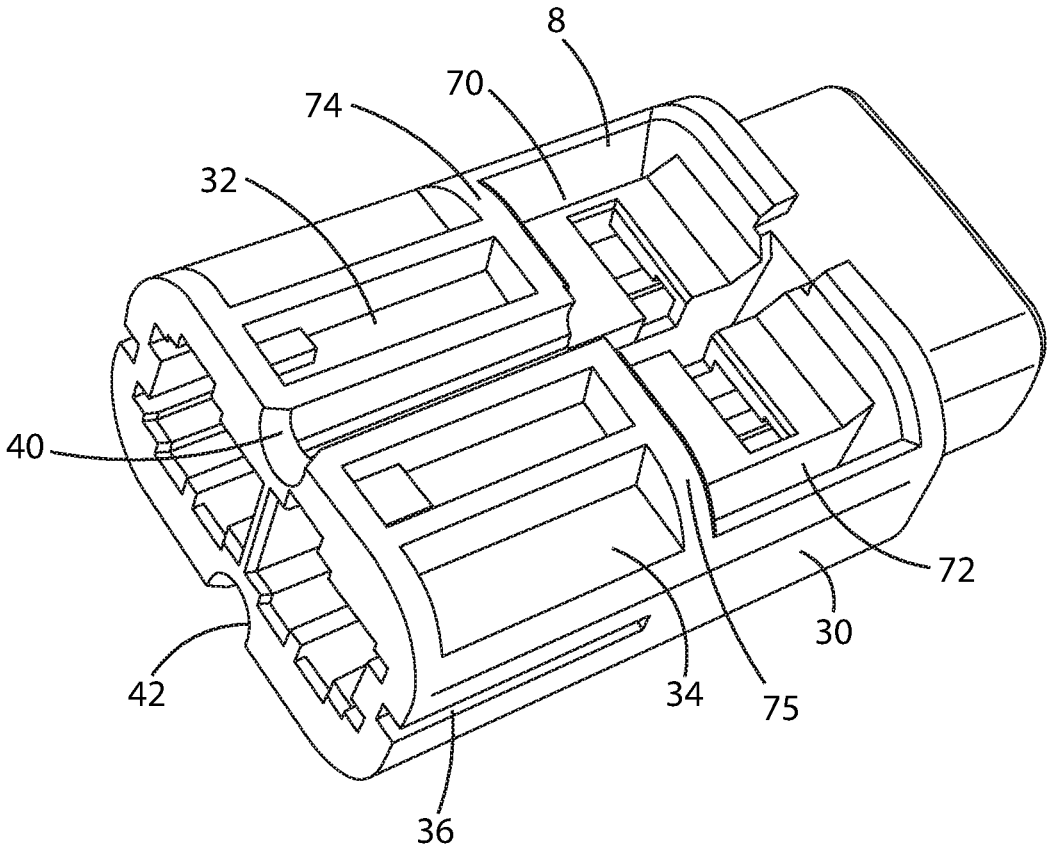
FIG. 12 is a top elevational view of the male inner housing, alone, and without the male TPA device inserted therein.

FIG. 12 illustrates a top elevational view of the male inner housing 30, alone, and without the male TPA device 1 inserted therein. Seen here are the fitting grooves 32, 34, 36 on the external surfaces of the male inner housing 30 for allowing the male inner housing 30 to be installed or inserted into the male outer housing 60. Moreover, on the upper outer surface of the male inner housing 30 are elongated grooves 70, 72, respectively, extending along upper sides 74, 75 of the male inner housing 30. The elongated groove 70 extending along the upper side 74 of the male inner housing 30 accommodates therein the end member 24 of the male TPA device, while the elongated groove 72 extending along the upper side 74 of the male inner housing 30 accommodates therein the end member 26 of the male TPA device 1 when the male TPA device 1 is pushed towards the pre-lock position and subsequently, towards the final-lock position, as discussed earlier with respect to, for example, FIGS. 9 and 10.

Figure 13:
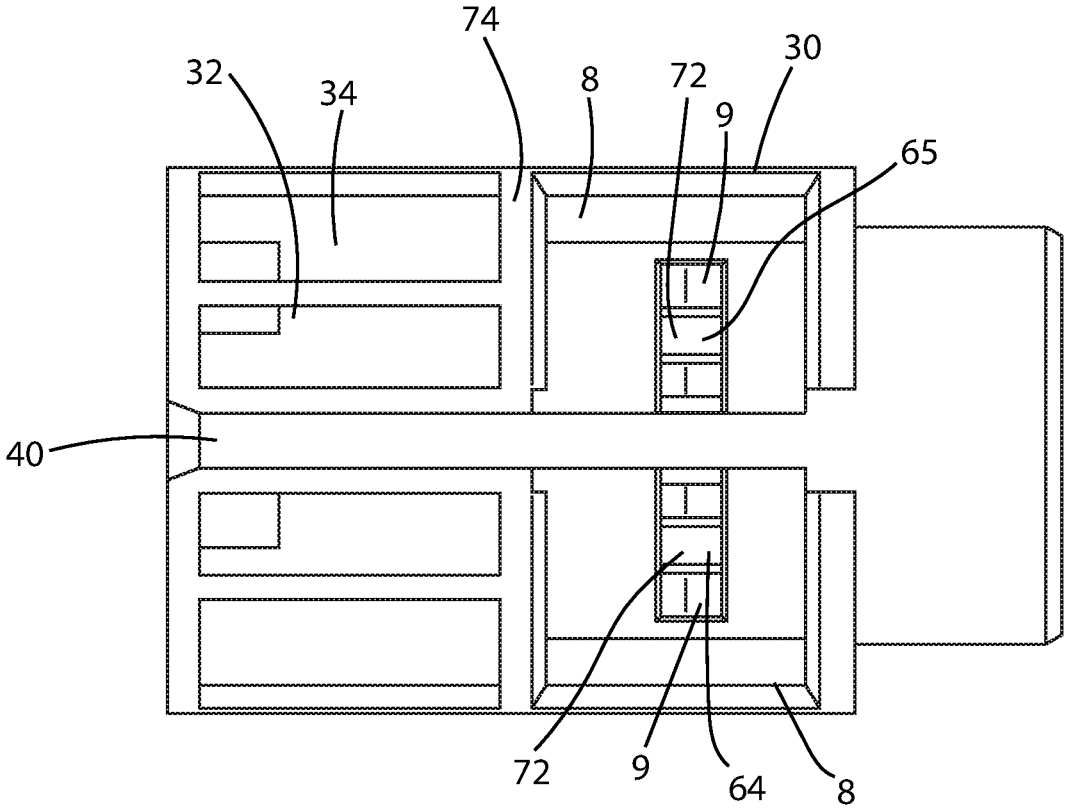
FIG. 13 is a top elevational view of the inner housing with terminals fully inserted therein.

FIG. 13 shows in a top elevational view the inner housing 30 with the terminals 65 fully inserted therein. Further seen in FIG. 13, through the opening 8 of the male inner housing 30, are the slots 72 of the terminals 65 ready to receive the corresponding intermediate members 28, 29 (with the corresponding nubs 31, 33) of the male TPA device 1 when the male TPA device 1 is inserted through an opening 9 of the male inner housing 30 in the pre-lock position and in the full-lock position.

Figure 14:
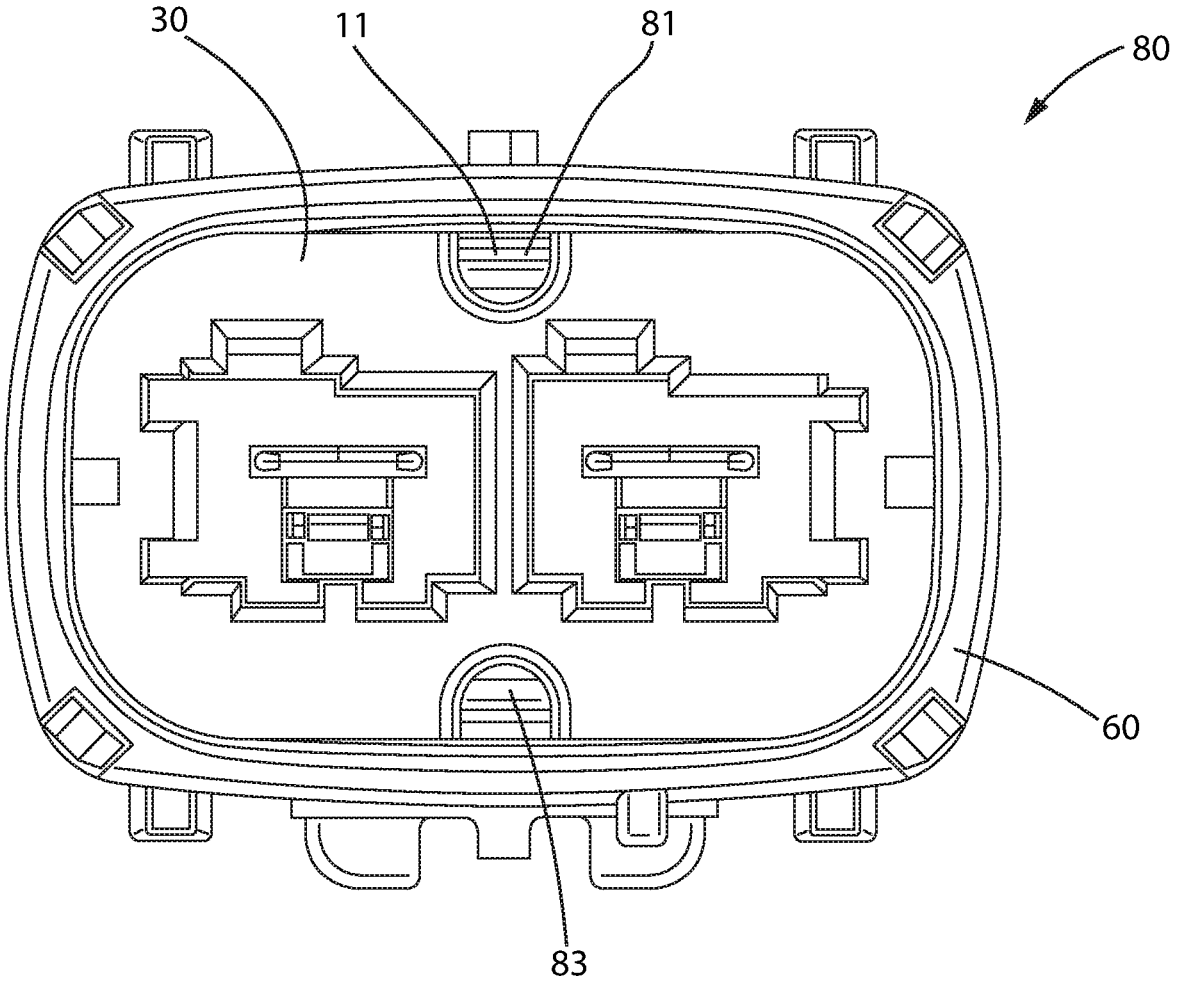
FIG. 14 is a front elevational view of the male connector assembly showing an upper access hole and a lower access hole through which the working device is to be inserted for pushing downward the male TPA device inside the male inner housing.
Figure 15:
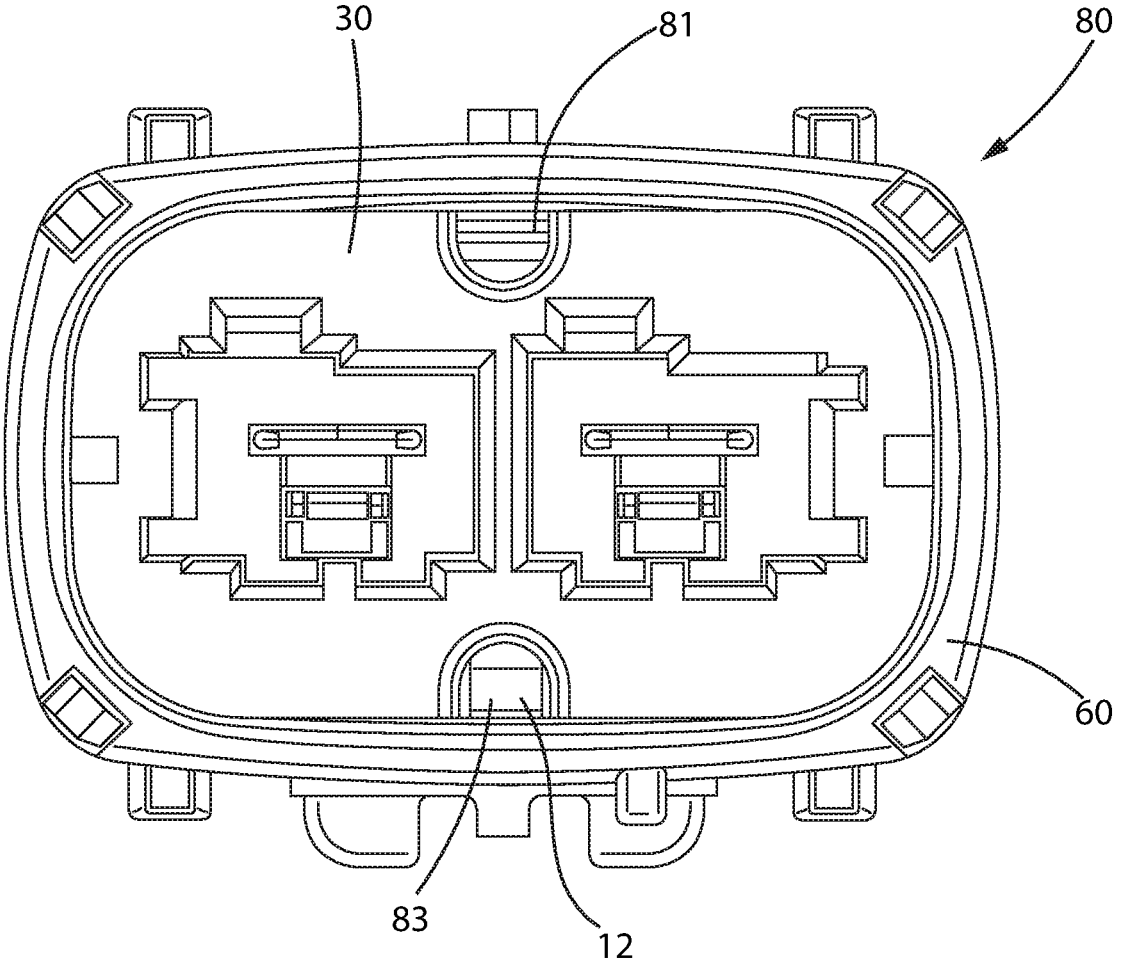
FIG. 15 is a front elevational view of the male connector assembly showing the upper access hole and the lower access hole through which the working device is to be inserted for pushing upward the male TPA device inside the male inner housing.

FIG. 14 is a front elevational view of the male connector assembly 80 showing an upper access hole 81 through which the working device (not shown) is to be inserted for pushing downward the male TPA device 1 inside the male inner housing 30, while FIG. 15 is a front elevational view of the male connector assembly 80 showing a lower access hole 83 through which the working device (not shown) is to be inserted for pushing upward the male TPA device 1 inside the male inner housing. In other words, FIGS. 14 and 15 show the upper access hole 81 and the lower access hole 83 of the male connector assembly 80, provided by the upper groove 40 and the lower groove 42, respectively, of the male inner housing 30 through which the working device (not shown) traverses or passes through, as discussed earlier with respect to, for example, FIGS. 6 and 11.

The method for assembling or operating the male TPA device 1 in the male inner housing 30 for providing the secondary locks for the terminals 65 therein is hereinafter described. The terminals 65 are initially inserted into the inner male housing 30. For example, one of the terminals 65 is fully inserted into the male inner housing 30 until the upward extending nub 70 at the lower portion inside the inner housing 30 with the ramp-like rear edge 73 is snapped towards and into the inside of the notch 72 at the lower portion of the terminal 65. The terminal 65 is then in a primary lock position, and the terminal 65 cannot be pulled out from the male inner housing 30 (i.e., the primary locks for the terminals 65 inside the male inner housing 30 are now in operation).

For full assurance that the terminals 65 remain locked inside the male inner housing 30, the following additional steps are hereinafter described. When, for example, the terminal 65 is in the primary lock inside the inner housing 30, as described above, the slot 72 of the terminal 65 is ready to receive the corresponding one of the intermediate members 28, 29 (with the corresponding one of the nub members 31, 33) of the male TPA device 1 when the male TPA device 1 is lowered and enters through the opening 8 of the male inner housing 30.

When inside the male inner housing 30 and having passed through the opening 8 of the male inner housing 30, the male TPA device 1 can be further pushed downward with the working device inserted into the upper access hole 81 and through the upper elongated groove 40 above the male inner housing 30 towards the inclined upper portion 11 of the flexible arm member 18. When the working device is further pushed towards the inclined upper portion 11, the lower member 5 of the male TPA device 1 is lowered, and a lower protruding member or nub member 21 of the flexible arm member 18 bypasses and travels towards beneath the protruding member or nub member 50 of the male inner housing 30. At such time, the lower member 5 or the male TPA device 1 is at a pre-lock position inside the male inner housing 30. Also at such time, the end members 24, 26 of the male TPA device 1 are accommodated within the elongated grooves 70, 72, respectively, of the male inner housing 30.

The method for placing the male TPA device 1 in full-lock position inside the male inner housing 30 is hereinafter described. When the male TPA device 1 is further lowered by the working device, the central member 23 of the male TPA device 1 is further pushed downward such that the upper protruding member or upper nub member 22 of the flexible arm member 18 travels beneath the protruding member or nub member 50 inside the inner housing 30 so that the lower member 5 of the male TPA device 1 and subsequently, the male TPA device 1 is at full-lock position inside the male inner housing 30. Simultaneously during the further lowering of the lower member 5 or the male TPA device 1 to the full-lock position, the intermediate members 28, 29 of the male TPA device 1 are fully inserted or accommodated within the corresponding slots 72 of the corresponding terminals 65. Consequently, with the lower member 3 of the male TPA device 1 or the male TPA device 1 being in full-lock position inside the male inner housing 30, the terminals 65 cannot be pulled away from the male inner housing 30 (i.e., the secondary locks for the terminals 65 inside the male inner housing 30 are now in operation). The secondary locks for the terminals 65 provide for much higher retention forces (in comparison to only when the primary locks for the terminals 65 are in operation), and provide a higher assurance that the terminals 65 remain locked inside the male inner housing 30.

In the event that it is desired that the male TPA device 1 be removed from the male inner housing 30, the working device is inserted into the lower access hole 83 (see FIG. 14), and the working device is pushed towards an inclined lower front portion 12 of the flexible arm member 18 of the male TPA device 1. By pushing the working device further towards the inclined lower front portion 12 of the flexible arm member 18, the lower member 5 of the male TPA device 1 is pushed upwards, thereby dislodging the engagements of the lower and upper protruding members or lower and upper nub members 21, 22 of the flexible arm member 18 from the protruding member or nub member 50 of the male inner housing 30. Consequently, the male TPA device 1 may be removed, through the opening 8 of the male inner housing 30, from the male inner housing 30.

The present invention is not limited to the above-described embodiments; and various modifications in design, structural arrangement or the like may be used without departing from the scope or equivalents of the present invention.

We claim:

1. A male terminal position assurance (TPA) device for a male connector assembly having an inner housing, comprising:

an upper member having opposing side members, said opposing side members having corresponding intermediate members respectively extending therefrom;

a lower member, said lower member of said male TPA device being in pre-lock position or full-lock position inside said inner housing, and wherein said intermediate members lock corresponding terminals inside said inner housing when said male TPA device is in full-lock position inside said inner housing, wherein at least an access hole of said inner housing receives a working device in one direction for moving said male TPA device in another direction and places said male TPA device in said pre-lock position or said full-lock position insider said inner housing.

2. The male TPA device according to claim 1, wherein said lower member includes a flexible arm member for locking said male TPA device inside said inner housing.

3. The male TPA device according to claim 2, wherein said flexible arm member includes at least a protruding member or a nub member extending therefrom, wherein said inner housing includes a protruding member or a nub member for engaging with a first protruding member or a first nub member of said flexible arm member when said TPA device is at a pre-lock position inside said inner housing.

4. The male TPA device according to claim 3, wherein said protruding member or said nub member of said inner housing engages with a second protruding member or a second nub member of said flexible arm member when said TPA device is at a full-lock position inside said inner housing.

5. The male TPA device according to claim 4, wherein said intermediate members are respectively accommodated within corresponding slots of said terminals to provide secondary locks for said terminals inside said inner housing when said male TPA device is at a full-lock position inside said inner housing.

6. The male TPA device according to claim 3, wherein end members of said male TPA device are respectively accommodated within corresponding elongated grooves on said inner housing when said TPA device is at a pre-lock position inside said inner housing.

7. The male TPA device according to claim 3, wherein end members of said male TPA device are respectively accommodated within corresponding elongated grooves on said inner housing when said TPA device is at a full-lock position inside said inner housing.

8. The male TPA device according to claim 7, wherein said intermediate members are respectively accommodated within corresponding slots of said terminals to provide secondary locks for said terminals inside said inner housing when said male TPA device is at a full-lock position inside said inner housing.

9. The male TPA device according to claim 1, wherein said inner housing includes a nub extending from a lower portion of said inner housing for engagement with a notch in a terminal so as to provide a primary lock for said terminal inside said inner housing.

10. A method for assembling a male terminal position assurance (TPA) device in a male inner housing, comprising the steps of:

inserting said TPA device into said inner housing through an opening thereof;

inserting at least one terminal inside said inner housing and providing a primary lock for said terminal inside said inner housing;

pushing said TPA device so as to provide a pre-lock position for said TPA device inside said inner housing; and thereafter, inserting a working device in one direction into an access opening of said inner housing to further push said TPA device in another direction so as to provide a full-lock position for said TPA device inside said inner housing, wherein said step of further pushing said male TPA device for providing said full-lock position for said male TPA device inside said inner housing includes the step of providing a secondary lock for said terminal inside said inner housing.

11. The method according to claim 10, wherein said step of inserting said terminal inside said inner housing includes a step of ensuring that a corresponding slot in said terminal accommodates therein a corresponding intermediate member of said male TPA device, and a step of providing said secondary lock to said terminal when said intermediate member of said male TPA device is accommodated within said corresponding slot of said corresponding terminal.

12. The method according to claim 11, wherein said step of providing said secondary lock to said terminal includes a step of assuring that said terminal is fully locked inside said inner housing.

13. The method according to claim 10, wherein said step of pushing said male TPA device inside said inner housing in said pre-lock position includes a step of at least a side member of said male TPA device being accommodated inside a corresponding elongated groove on said inner housing.

14. The method according to claim 10, wherein said step of further pushing said male TPA device inside said inner housing in said full-lock position includes a step of at least said side member of said male TPA device being accommodated inside a corresponding elongated groove on said inner housing.

15. The method according to claim 10, wherein said step of pushing said male TPA device inside said inner housing in said pre-lock position further includes a step of engaging a protruding member or a nub member extending inside said inner housing with a lower protruding member or a lower nub member extending from a flexible arm member of said male TPA device.

16. The method according to claim 10, wherein said step of further pushing said male TPA device inside said inner housing in said full-lock position further includes a step of engaging a protruding member or a nub member extending inside said inner housing with an upper protruding member or an upper nub member extending from a flexible arm member of said male TPA device.

17. A method for locking or unlocking a terminal position assurance (TPA) device in a housing of a connector assembly, comprising one of a step (a) and step (b):

(a) a step of inserting a working device in a first direction through an upper access opening of said housing or said connector assembly;
pushing in a second direction said TPA device; and
locking said TPA device in said housing of said connector assembly, and (b) a step of inserting said working device in said first direction through a lower access opening of said housing or said connector assembly;
pushing in a third direction said TPA device; and
unlocking said TPA device from or placing said TPA device in another locking state in said housing of said connector assembly, wherein said first direction and said second direction are dissimilar.

18. The method for locking or unlocking said terminal position assurance (TPA) device in said housing of said connector assembly according to claim 17, wherein said first direction and said third direction are dissimilar.

19. The method for locking or unlocking said terminal position assurance (TPA) device in said housing of said connector assembly according to claim 17, wherein said step of placing said TPA device in another locking state in said housing of said connector assembly, includes the step of pushing said TPA device from a full-lock position to a pre-lock position in said housing of said connector assembly.

* * * * *